US005215024A

United States Patent [19]

McAllister

[11] Patent Number: 5,215,024

[45] Date of Patent: Jun. 1, 1993

[54] VESSEL-CAPTURING BERTHING FACILITY INCORPORATING RELATIVE MOTION-MITIGATING APPARATUS

[75] Inventor: Keith R. McAllister, Davidsonville, Md.

[73] Assignee: The United States of America as represented by the Secretary of the Navy, Washington, D.C.

[21] Appl. No.: 868,426

[22] Filed: Apr. 15, 1992

[51] Int. Cl.[5] ..... B63C 1/02

[52] U.S. Cl. ..... 114/45; 114/219

[58] Field of Search ..... 114/44, 45, 46, 47, 114/220, 251, 219; 405/219, 218

[56] References Cited

U.S. PATENT DOCUMENTS

| | | | |
|---|---|---|---|
| 2,594,773 | 4/1952 | Harris | 114/220 |
| 3,084,517 | 4/1963 | Bell | 114/220 |
| 3,133,518 | 5/1964 | Burnett | 114/47 |
| 3,362,372 | 1/1968 | Peterson | 114/251 |
| 3,585,958 | 6/1971 | Naczkowski | 114/220 |
| 3,610,192 | 10/1971 | Mauritzen | 114/45 |
| 3,957,010 | 5/1976 | Soulant | 114/123 |
| 4,106,637 | 8/1978 | Marsden | 214/13 |
| 4,510,877 | 4/1985 | Bloxham | 114/45 |

OTHER PUBLICATIONS

Kaplan "Centerline" published by David Taylor Naval Research Center, pp. 1,2,8, Jun. 1989.

Blaker "United States Overseas Basing" ©1990, pp. 150–152.

Hightower "Floating Stable Platforms: Concepts and U.S. Activities".

*Primary Examiner*—Jesûs D. Sotelo

*Assistant Examiner*—Stephen P. Avila

*Attorney, Agent, or Firm*—Charles D. Miller

[57] ABSTRACT

An open ocean-based berthing facility for capturing a ship or similar vessel in order to mitigate wind, wave and current-induced relative motion between the berthing facility and the vessel includes a buoyant platform having an enclosure formed therein for receiving the vessel. When the vessel is positioned within the platform enclosure, it is isolated from the open ocean yet remains afloat since the enclosure is filled with water. When the vessel is positioned within the enclosure and isolated from the open ocean, its movement is coupled to the movement of the platform. Coupling the movement of the vessel to the movement of the platform greatly reduces the relative motion between the vessel and the platform and thereby reduces the risk of both physical damage to the vessel and platform and reduces the risk of injury to operating and maintenance personnel.

14 Claims, 8 Drawing Sheets

VESSEL-CAPTURING BERTHING FACILITY INCORPORATING RELATIVE MOTION-MITIGATING APPARATUS

RIGHTS OF THE GOVERNMENT

The invention described herein may be manufactured and used by or for the Government of the United States of America for governmental purposes without the payment of any royalties thereon or therefor.

CROSS REFERENCE TO RELATED APPLICATION

Reference is hereby made to the following copending U.S. Patent Application dealing with related subject matter and assigned to the assignee of the present invention: "Operating At Sea Island Station" by Keith R. McAllister, assigned U.S. Ser. No. 07/788,625 and filed Nov. 1, 1991.

BACKGROUND OF THE INVENTION

1. Field of the Invention

The present invention relates generally to an at-sea vessel berthing facility and, more particularly, to an at-sea vessel-capturing berthing facility incorporating apparatus for mitigating relative motion between the berthing facility and the vessel.

2. Description of the Prior Art

Presently, the United States military must rely on overseas operating bases located on foreign soil to maintain an effective presence throughout the world. As stated in an article by James R. Blaker entitled "U.S. Overseas Basing System Faces A Difficult Transition", *Armed Forces Journal International, February,* 1989, pages 65 through 67, continued access by the U.S. military to these overseas land bases is becoming increasingly costly from a monetary standpoint and politically more difficult to maintain.

Over the past three decades, there have been two broad categories of monetary costs associated with overseas land basing. One of these may be referred to as the "fixed" costs of basing-fixed in the sense that these costs are tied directly to the facilities and installations built and maintained at the bases. These fixed costs can vary greatly from base to base, depending on the local costs, the design of the facility and its environment. Although some fixed costs are paid for by the nation in which the base is located, the greatest portion of the fixed costs are provided for under the defense budget and are ultimately paid for by the U.S. taxpayer. It is apparent that as world-wide inflation increases, the cost to the U.S. taxpayer proportionately increases.

The other broad category of monetary costs associated with maintaining overseas land bases is referred to as "permit" costs which are paid to a foreign nation to obtain the privilege and authority to build, improve and maintain a U.S. military facility on the nations's territory. In 1990, U.S. overseas land base permit costs ran at approximately seven (7) billion dollars The U.S. government paid approximately five (5) billion of this total, and the remainder was contributed by the U.S. taxpayer. To appreciate how rapidly these permit costs are rising, consider that in 1975, permit costs ran at roughly two hundred (200) million dollars, and by 1980, had risen to one (1) billion dollars. As with the increases in the fixed costs of overseas land basing, the majority of the increases in permit costs has also borne by the U.S. taxpayer.

In addition to the increased financial costs associated with the continued maintenance of overseas land bases, it has also become increasingly more difficult to deal politically with some foreign nations regarding continued U.S. access to these land bases. One need only consider Spain's rejection of a U.S. F-16 squadron in the late 1980's and the continued diplomatic sparring with the Philippines over base access and access compensation to recognize the political difficulties associated with maintaining foreign land bases.

The continued financial and political difficulties associated with the maintenance of foreign land bases has caused both the government and the industrial sector to examine alternatives to the foreign land base approach. For example, numerous concepts have been presented for airfields located at sea and for large, rectangular shaped "super islands" which in effect operate as multi-use floating complexes measuring one mile or more on a side. It has been suggested that these super islands be used as a replacement for foreign land bases. It is envisioned that the design characteristics of the super island would allow either industrial or military use.

Although the super island approach has recently been investigated to eliminate the problems associated with foreign land bases, the concept of large floating structures that can be used for floating cities, airfields or manufacturing facilities is not new. A form of the concept dates at least to 1932 when it was seriously proposed that stable landing fields be built in the mid-Atlantic as refueling stations to extend the range of commercial aircraft. Until recently the required technology was not available to advance the super island from the concept stage. With new developments in modular floating platform technology, however, the super island may indeed become a reality in the near future.

Although the utilization of super islands would eliminate the financial and political difficulties presently experienced with the maintenance of foreign land bases, super islands as presently envisioned would present their own set of difficulties with both construction and maintenance. For example, feasible transportation of the large modules forming the island structure from their point of manufacture to a location in international waters off the coast of a foreign land is doubtful, as is the connection of these large modules in an open seaway with today's methodology. Another anticipated limitation to the use of a structure as large as a super island containing all basing functions is its vulnerability to hostile attack.

An alternative to the super island approach is the subject of the above cross-referenced U.S. patent application Ser. No. 07/788,625, entitled "Operating At Sea Island Station". This application teaches the use of a plurality of discrete, floating operating units or vessels which may either be towed, hauled or self-propelled into position on the open ocean to form an operating base.

However, it is apparent that if the plurality of discrete operating units are to function as a single, self-sustained operating base, one or more of the operating units must be accessible by supply ship or other similar vessel to allow cargo and other supplies required by the base and carried by the ship or vessel to be unloaded and stored if desired. In addition, at least some of the operating units must be accessible by ship or vessel in order to allow transfer of cargo stored on these operating units to the remainder of the operating units forming the base.

One of the concerns regarding access to an operating unit positioned on the open ocean by ships or other similar vessels is the relative motion between the operating unit and the vessel which will occur when the vessel is docked with the operating unit for purposes of on or off-loading supplies. It is well known that on the open ocean, the wind, waves and currents cause dissimilar motion responses in different vessels. This relative motion between the operating unit and the vessel in open ocean conditions rapidly becomes destructive with sea states in excess of 3.

Consequently, a need exists for an at-sea docking or berthing facility which is capable of capturing a vessel in order to mitigate wind, wave and current-induced relative motion between the berthing facility and the vessel to permit safe and efficient on or off-loading of cargo to or from the vessel, or to permit the vessel to be serviced at sea.

SUMMARY OF THE INVENTION

The present invention relates to a berthing facility designed to satisfy the aforementioned needs. The berthing facility is formed from a buoyant platform having an enclosure formed therein for receiving a ship or other similar vessel. When the ship or vessel is positioned within the platform enclosure, it is isolated from the open ocean yet remains afloat since the enclosure is filled with water. Since the ship or vessel is positioned within the enclosure and is isolated from the open ocean, its movement is coupled to any movement of the platform caused by wind, waves and currents. Coupling the movement of the ship to the movement of the buoyant platform greatly reduces the relative motion between the ship and the platform, thereby reducing the risk of physical damage to the ship and platform and, more importantly, reducing the risk of injury to operating or maintenance personnel.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
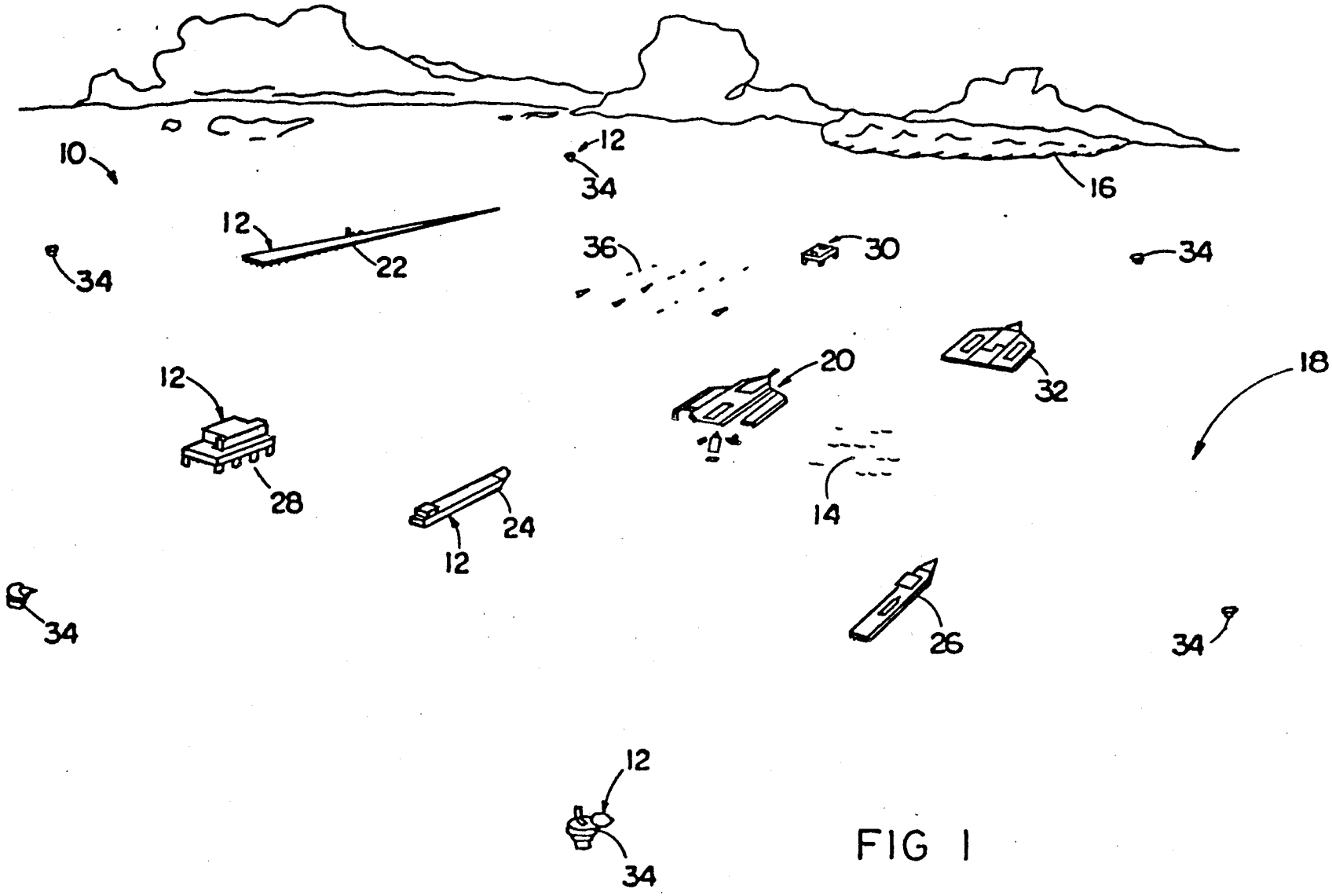
FIG. 1 is a perspective illustration of a plurality of discrete operating units forming an operating base referred to as an Operating At Sea Island Station (OASIS)

In the following description, like reference characters designate like or corresponding parts throughout the several views. Also in the following description, it is to be understood that such terms as "forward", "rearward", "left", "right", "upwardly", "downwardly" and the like, are words of convenience and are not to be construed as limiting terms.

IN GENERAL

Referring to the drawings, and particularly to FIG. 1, there is shown a perspective illustration of an Operating At Sea Island Station (OASIS) being generally designated by the numeral 10. The OASIS 10 is formed from a plurality of discrete operating units, each generally designated by the numeral 12, brought together to meet a specific basing requirement and operable as a sea-based naval station located in international waters. Since the OASIS 10 may be positioned in international waters off the coast of most foreign nations, it will greatly reduce or eliminate the need for many of the land bases presently required to be maintained by the U.S. government in order to maintain a global presence.

The OASIS 10 uses the ocean surface in a manner similar to the ground on a land base. The discrete operating units 12 are relocatable and transportable since they may either be towed, transported as dry cargo on a heavy lift semi-submersible ship or self-propelled from one area of the sea to another as a mission or task performed by the OASIS 10 is completed, or as the mission or task of the OASIS 10 changes. Each of the discrete operating units 12 may either be moored or dynamically positioned depending upon their location and sea depth. For example, the discrete operating units 12 may be moored in locations where the sea depth is less than one thousand (1000) feet and positioned utilizing conventional dynamic positioning technology in locations where the sea depth ranges between one thousand (1000) and twenty thousand (20,000) feet. Thus, the individual operating units 12 forming the OASIS 10 are configured with both mooring and dynamic positioning systems to enable their effective use over a wide range of sea depths. The fact that the OASIS 10 is transportable and relocatable from one sea location to another provides the U.S. naval forces with the capability of establishing an American presence anywhere in the world on short notice, and can also serve as a sea-based station in times of crisis.

If utilized for naval applications, the OASIS 10 may serve as an advance logistics support base located near an operating area, just out of the zone of conflict. The benefits of using the OASIS 10 in this manner are a) reducing the length of the supply lines to the forces located in the operating area, and b) enabling merchant containerized cargo to be packaged for military use free from hostile forces.

The OASIS 10 may also serve as a critical node base positioned strategically as a link in a basing network, or as a forward operating base for U.S. forces operating from over-the-horizon, anti-submarine operations or drug interdiction forces.

As seen in FIG. 1, the plurality of discrete operating units 12 forming the OASIS 10 are positioned on the sea surface 14 in international waters off the shoreline of a body of land 16. Each of the discrete operating units 12 is positioned on the sea surface 14 within an area 18 defined by the six operations units 12 located around the periphery of the area 18.

In the example of the OASIS 10 illustrated in FIG. 1, the plurality of discrete operating units 12 are designed to provide an air and sea-capable resupply and maintenance station. Thus, the plurality of discrete operating units 12 includes a berthing facility or supply center 20 (which is the subject of the present invention) for on and off-loading cargo to be used at the OASIS 10, an airfield 22, a fuel facility 24 for storing fuel to be used by vessels passing through the OASIS 10 and for planes landing on the airfield 22, a ship repair unit 26, an aircraft repair unit 28, an administrative unit 30, an ammunition center 32 and six self defense units 34 located around the periphery of the area 18. Since the operating units 12 are positioned on the sea surface 14 and spread over an area typically measuring ten nautical (10) miles on a side, ships entering and leaving the OASIS 10 to either deliver or receive cargo, undergo repairs or dispatch or take on troops have sufficient room to navigate without fear of colliding with other ships moving through the OASIS 10 or with the operating units themselves. A mooring farm 36 consisting of a plurality of conventional single point mooring units is located generally in the center of the OASIS 10 to provide a docking area for ships remaining in the OASIS 10 for an extended period of time. The mooring farm 36 is located in a position which is removed from the heavier traffic routes of ships passing through the OASIS 10. For a more detailed description of the construction and operation of all the various components forming the OASIS 10 with the exception of the berthing facility 20, reference is made to the copending patent application referred to under "Cross Reference To Related Application".

VESSEL-CAPTURING BERTHING FACILITY OF THE PRESENT INVENTION

Figure 2:
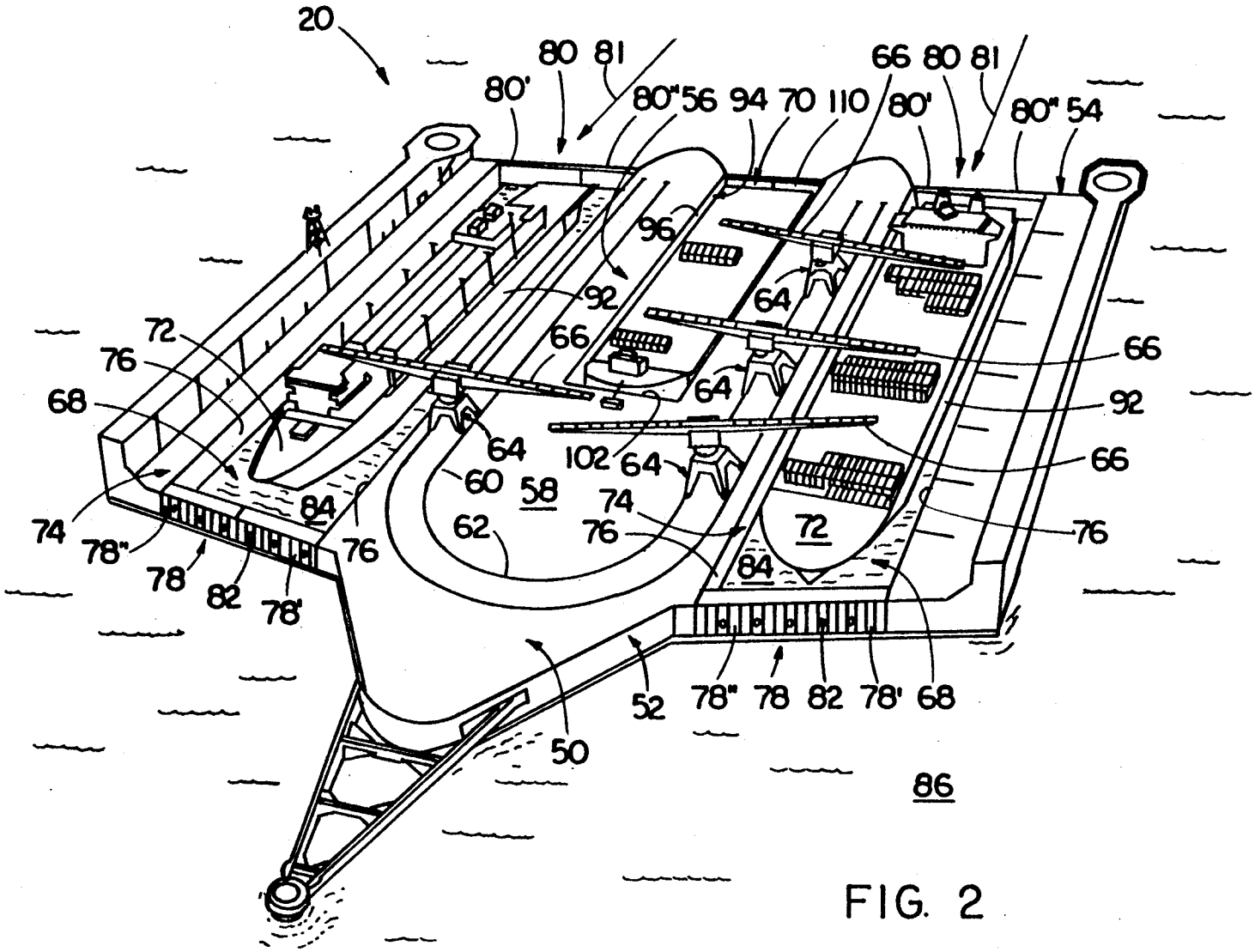
FIG. 2 is a perspective view of one of the operating units of the OASIS referred to as a vessel-capturing berthing facility and itself the subject of the present invention.
Figure 3:
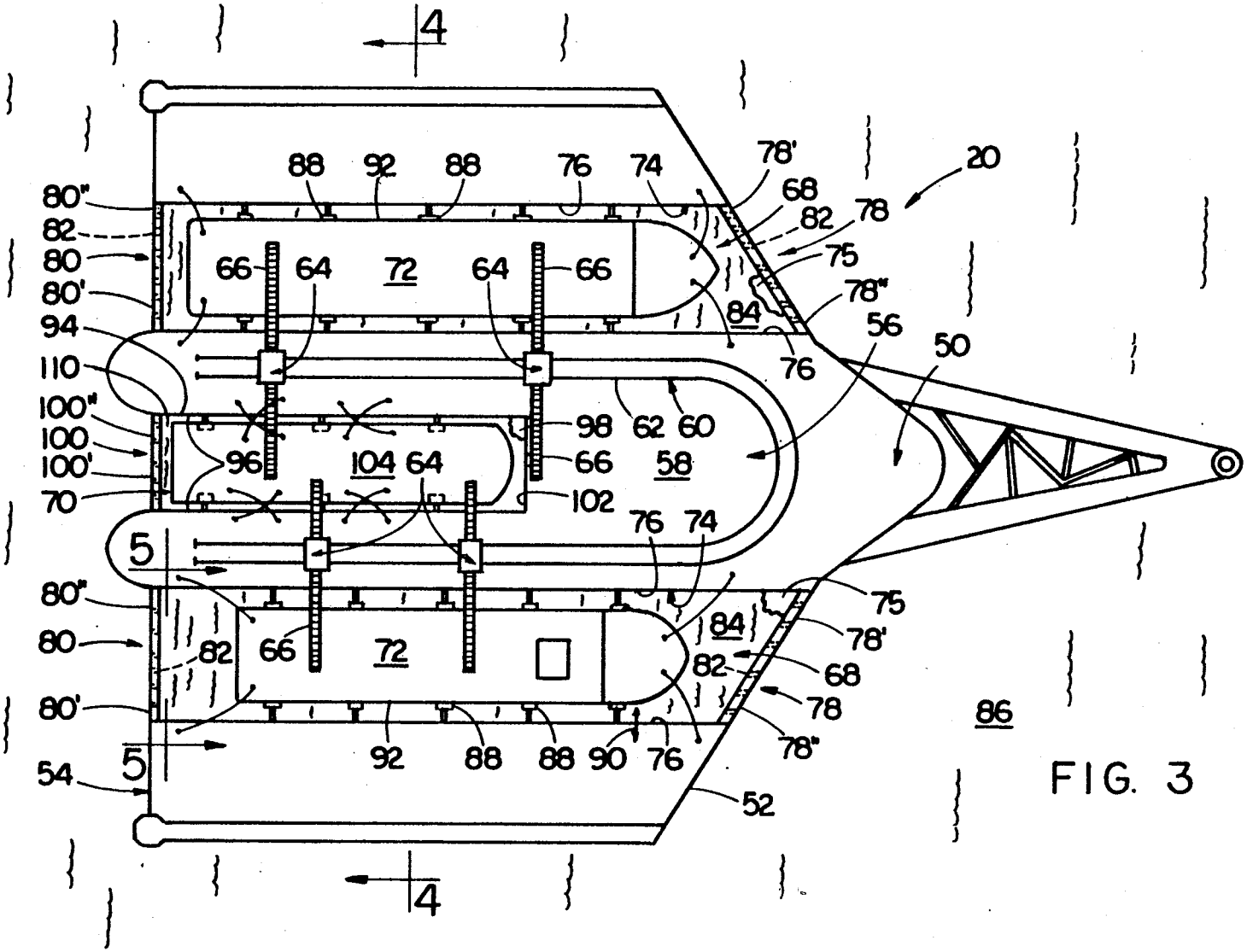
FIG. 3 is a top plan view of the vessel-capturing berthing facility illustrated in FIG. 2.

Now referring to FIGS. 2 and 3, there are illustrated perspective and top plan views, respectively, of the berthing facility or supply center 20 of the present invention. As will be described herein, the berthing facility 20 is operable to capture a vessel such as a ship or barge so as to mitigate any movement of the vessel induced by wind, waves or currents relative to the berthing facility 20. In this manner, relative motion between the vessel and the berthing facility 20 is mitigated. It should be understood from the following that although the vessel-capturing concept is described herein as a feature of the OASIS supply center 20, the vessel-capturing concept itself may be applied to sea-based facilities of all types. Therefore, the incorporation of the vessel-capturing concept with the supply center 20 is described herein as only an example of how the vessel-capturing concept may be utilized.

The berthing facility 20 includes a buoyant platform 50 having a forward end portion 52, a rearward end portion 54 and a center portion 56 extending between the forward end portion 52 and the rearward end portion 54. The center portion 56 has a deck surface 58 for supporting a crane system 60 including a track 62 and a plurality of cranes 64. Each of the cranes 64 is movable on the track 62 so that the boom extensions 66 of each of the cranes 64 may be positioned over a pair of "drive-through" enclosures 68 and a "drive-in/back-out" enclosure 70 formed in the berthing facility 20.

The pair of drive-through enclosures 68 are each formed from a channel generally designated by the numeral 74 formed from a pair of opposing sidewalls 76 extending between the forward and rearward end portions 52, 54 of the platform 50 and a bottom wall 75. The pair of opposing sidewalls 76 and the bottom wall 75 give the channel 74 a generally "U" shaped appearance when the channel is viewed from either the forward end portion 52 or the rearward end portion 54 of the platform 50. Each enclosure 68 may include a forward locking gate 78, a rearward locking gate 80 or both forward and rearward locking gates 78, 80. Each of the enclosures 68 is filled with water and sized to hold a cargo or supply vessel such as either of the vessels 72.

A vessel 72 may be driven into a selected enclosure 68 by opening, for example, the selected enclosure's rearward locking gate 80. Once the rearward locking gate 80 is opened, the vessel 72 may be driven in a direction indicated by the directional arrows 81 and into the channel 74 forming a portion of the selected drive-through enclosure 68. After the vessel 72 is in floating position within the channel 74 of the selected enclosure 68, the rearward locking gate 80 is closed and the vessel 72 is thus captured within the selected enclosure 68. The forward and rearward locking gates 78, 80 of each of the enclosures 68 have holes 82 extending therethrough which are sized to allow water to flow between the interiors 84 of the enclosures 68 and the open ocean 86 in order to permit water level equalization without permitting significant wave energy to enter either of the enclosures 68. After cargo is loaded onto or removed from the vessel 72, the forward locking gate 78 or the rearward locking gate 80 of the selected enclosure 68 is opened to allow the vessel 72 to be driven out of the berthing facility 20 and into the open ocean 86. It should be understood that although each of the forward locking gates 78 is illustrated in FIGS. 2 and 3 as including a pair of swing-out gate sections 78′ and 78″, and each of the rearward locking gates 80 is illustrated in FIGS. 2 and as including a pair of swing-out gate sections 80′ and 80″, both the forward and rearward locking gates 78 and 80 may be single gate sections arranged to either swing or slide between open and closed positions. The single gate sections may be side or bottom hinged for opening.

As seen particularly in FIG. 3, once a vessel 72 is positioned within an enclosure 68 formed in the berthing facility 20, resilient transverse members 88 which are positioned on or within each of the channel sidewalls 76 associated with the enclosure 68 and reciprocally movable between a retracted position and a contact position, as indicated by the directional arrow 90, are brought into contact with the hull 92 of the vessel 72. The plurality of resilient transverse members 88 are operable to fix the position of the vessel 72 within the enclosure 68.

As seen in FIGS. 2 and 3, capturing a vessel 72 within an enclosure 68 formed in the berthing facility 20 and fixing the position of the vessel 72 within the enclosure 68 via the plurality of resilient transverse members 88 assists the vessel 72 to move with the berthing facility 20 as the berthing facility 20 is buffeted by wind, waves and ocean currents. Since the vessel 72 is captured within the berthing facility 20, relative motion between the vessel 72 and the berthing facility 20 is significantly mitigated.

As further seen in FIGS. 2 and 3, the "drive-in/back-out" enclosure 70 is formed from a channel 94 including a pair of opposing vertical sidewalls 96 extending from the platform rearward end portion 54 a preselected distance into the center portion 56 of the platform 50, and a horizontally positioned bottom wall 98 extending between the sidewalls 96 so that the channel 70 has a generally "U"-shaped appearance when viewed from the platform rearward end portion 54. The enclosure 70 further includes a rearward locking gate 100 located at the platform rearward end portion 54 and a wall 102 spanning the channel 94 operable to close the end portion of the channel 94 located in the center portion 56 of the platform 50. The enclosure 70 is filled with water and sized to capture a vessel in the form of an ocean-going barge 104. Although the enclosure 70 is described herein as including a rearward locking gate 100, it should be understood that the rearward locking gate 100 may be eliminated without effecting the operation of the enclosure 70.

The barge 104 may be driven into the enclosure 70 by opening the rearward locking gate 100 and maneuvering the barge 104 towards the entry 106 of the enclosure 70. Once the barge 104 is positioned at the entry 106 of the enclosure 70, a winch or tugger assembly 108 may be secured to the barge 104 and operated to pull the barge 104 into the interior 110 of the enclosure 70. After the barge 104 is pulled into the interior 110 of the enclosure 70, the rearward locking gate 100 is closed, thus capturing the barge 104 within the berthing facility 20. With the barge 104 captured within the enclosure 70, cargo or other supplies may be on or off-loaded via the plurality of cranes 64. After the work to be done by the barge 104 within the berthing facility 20 is completed, the rearward locking gate 100 is opened to allow the barge to be pulled out of the enclosure 70 by a tugboat or other similar vessel. As with all the other locking gates previously described, the locking gate 100 includes a plurality of holes 82 which pass therethrough to allow the water level within the interior 110 of the enclosure 70 to equalize with the water level of the open ocean 86. In addition, although the locking gate 100 illustrated in FIGS. 2 and 3 includes a pair of gate sections 100′ and 100″, the locking gate may be a single section which either swings or slides between open and closed positions.

As particularly seen in FIG. 3, a plurality of resilient transverse members, illustrated in phantom and designated by the numerals 112, positioned on each of the enclosure 70 sidewalls 96 engage the sidewalls 105 of the barge 104 to fix the position of the barge 104 within the enclosure 70.

Capturing the barge 104 within the enclosure 70 and fixing the position of the barge 104 within the interior 110 of the enclosure 70, via the plurality of resilient transverse members 112, assists the barge 104 in moving with the berthing platform 20 as the berthing platform 20 is buffeted by winds, waves and ocean currents. Since the barge 104 is captured within the berthing platform 20, relative motion between the barge 104 and the berthing platform 20 is significantly mitigated.

Figure 4:
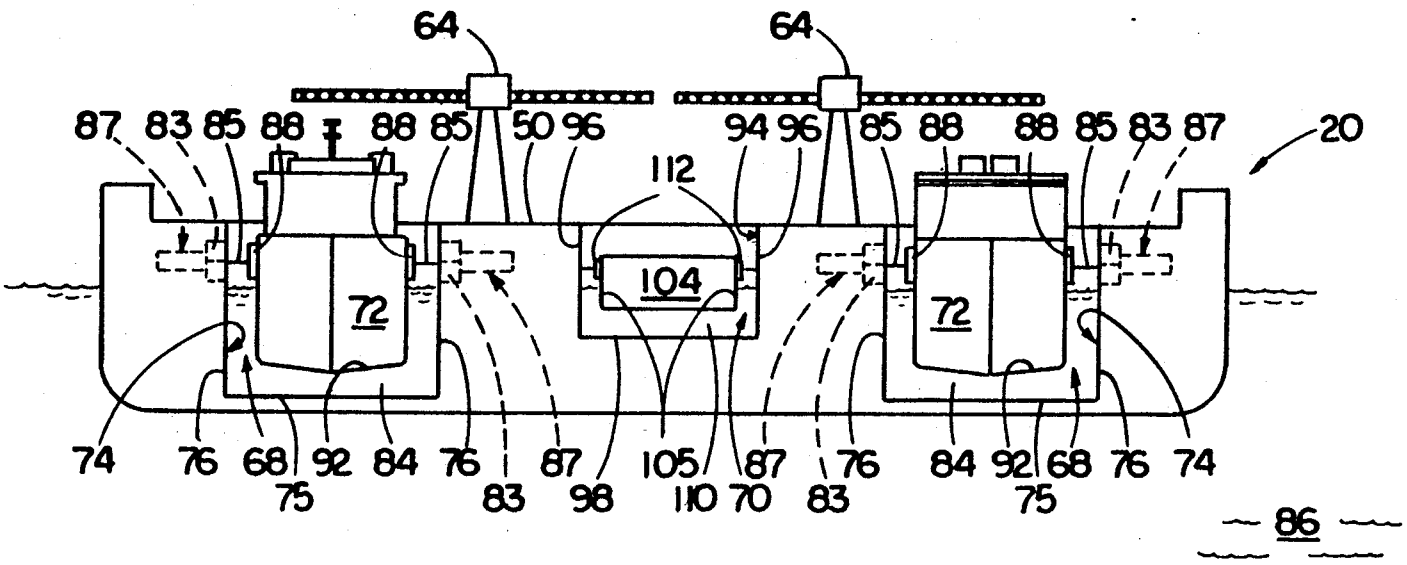
FIG. 4 is a cross-sectional view of the berthing facility taken along line 4—4 of FIG. 3.

Now referring to FIG. 4, there is illustrated a cross sectional view of the berthing facility 20 taken along line 4—4 of FIG. 3. FIG. 4 illustrates that the channel 74 of each of the drive-through enclosures 68 and the channel 94 of the "drive-in/back-out" enclosure 70 formed in the buoyant platform 50 have a generally "U"-shaped appearance. As seen in FIG. 4, the channel 74 of each of the enclosures 68 is formed from the pair of opposing, substantially vertical sidewalls 76 and the substantially horizontally positioned bottom wall 75. The interior 84 of each enclosure 68 is of sufficient size to allow the vessel 72 to freely float within the channel 74 while clearance between the vessel 72 and the sidewalls 76 and bottom wall 75 is maintained. With the vessel 72 positioned within the interior 84 of a channel 68, the resilient transverse members 88 normally positioned within the pockets 83 formed in the sidewalls 76 of the channel 68 and connected via the piston rods 85 of the pneumatic or hydraulic cylinders 87 may be brought into contact with the hull 92 of the vessel 72 by operation of the pneumatic or hydraulic cylinders 87 to fix the position of the vessel 72 within the berthing facility 20.

As further seen in FIG. 4, the channel 94 of the enclosure 70 is formed from the pair of opposing, substantially vertical sidewalls 96 and the substantially horizontally positioned bottom wall 98. The interior 110 of the enclosure 70 is of sufficient size to allow the barge 104 to freely float within the channel 94 while clearance between the barge 104 and the sidewalls 96 and bottom wall 98 is maintained. With the barge 104 positioned within the interior 110 of the channel 70, the resilient transverse members 112 positioned on the sidewalls 96 of the channel 94 engage the sidewalls 105 of the barge 104 to fix the position of the barge 104 within the berthing facility 20. It is apparent from FIG. 4 that the sidewalls and bottom walls of the enclosures 68 and 70 prevent waves and swells from moving the vessels 72 and barge 104 independently of the berthing facility 20. With the vessels 72 and barge 104 fixed in position, the plurality of cranes 64 may be operated to on and off-load cargo and transfer cargo between vessels and barge as required without fear of relative motion-induced damage occurring to either the vessels, the barge or the berthing facility.

Figure 6:
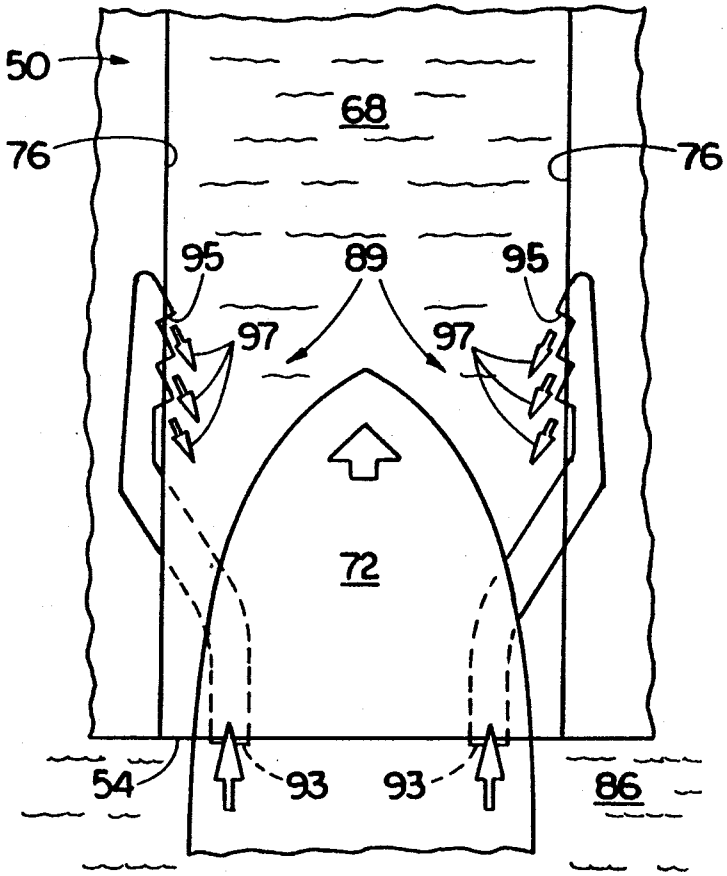
FIG. 6 is a top plan view of the vessel-capturing enclosure and water flow apparatus of FIG. 5.
Figure 5:
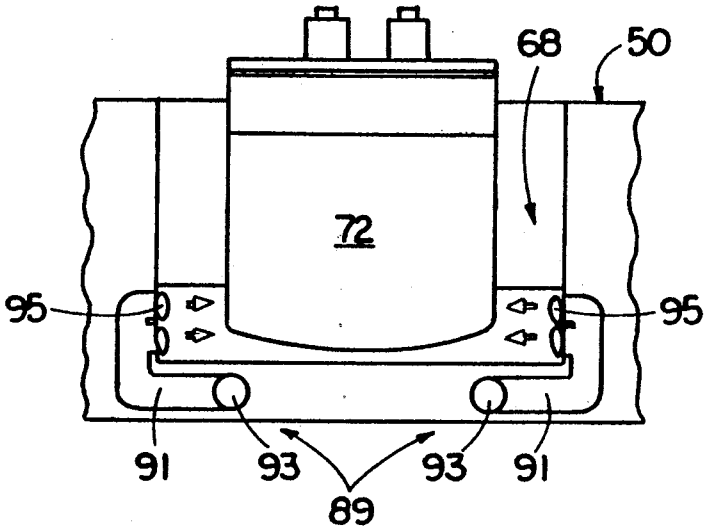
FIG. 5 is a side elevational view of one of the drive through vessel-capturing enclosures forming a portion of the berthing facility of the present invention taken alone line 5—5 of FIG. 3 and having the enclosure's rearward locking gates removed for clarity, illustrating a water flow apparatus for easing the entry of a vessel into the enclosure.

Now referring to FIGS. 5 and 6, there is illustrated a water flow apparatus 89 positioned within the buoyant platform 50 in communication with one of the drive-through enclosures 68 and operable to ease the entry of the vessel 72 into the drive-through enclosure 68. Although a water flow apparatus 89 is illustrated in FIGS. 5 and 6 in communication one of the drive-through enclosures 68, it should be understood that a water flow apparatus 89 is utilized with each drive-through enclosure 68.

As seen in FIGS. 5 and 6, the water flow apparatus 89 includes a pair of ducts 91 each having an inlet 93 and a plurality of outlets 95. Each of the pair of ducts 91 is positioned within the buoyant platform 50 and oriented so that the inlet 93 of each duct 91 is located within the open sea 86 rearward of the rearward end portion 54 of the buoyant platform 50 and the plurality of outlets 95 of each duct 91 are located along one of the vertical sidewalls 76 of the enclosure 68 below the water level within the enclosure 68. The entry of the vessel 72 into the enclosure 68 is eased by passing a high volume of water through the ducts 91, the water entering each of the inlets 93 and exiting the plurality of outlets 95 (as indicated by the arrows 97). The high volume of water exiting the outlets 95 acts as a fluid cushion to slow the vessel 72 down as it enters the enclosure 68. In addition, the high volume of water flow past the bow of the vessel 72 produced by each duct 91 acts as a fluid fender to prevent the vessel 72 from veering towards the sidewalls 76 of the enclosure 68. If desired, booster pumps (not shown) may be utilized to increase the flow rate of water exiting the ducts 91 outlets 95.

Figure 7:
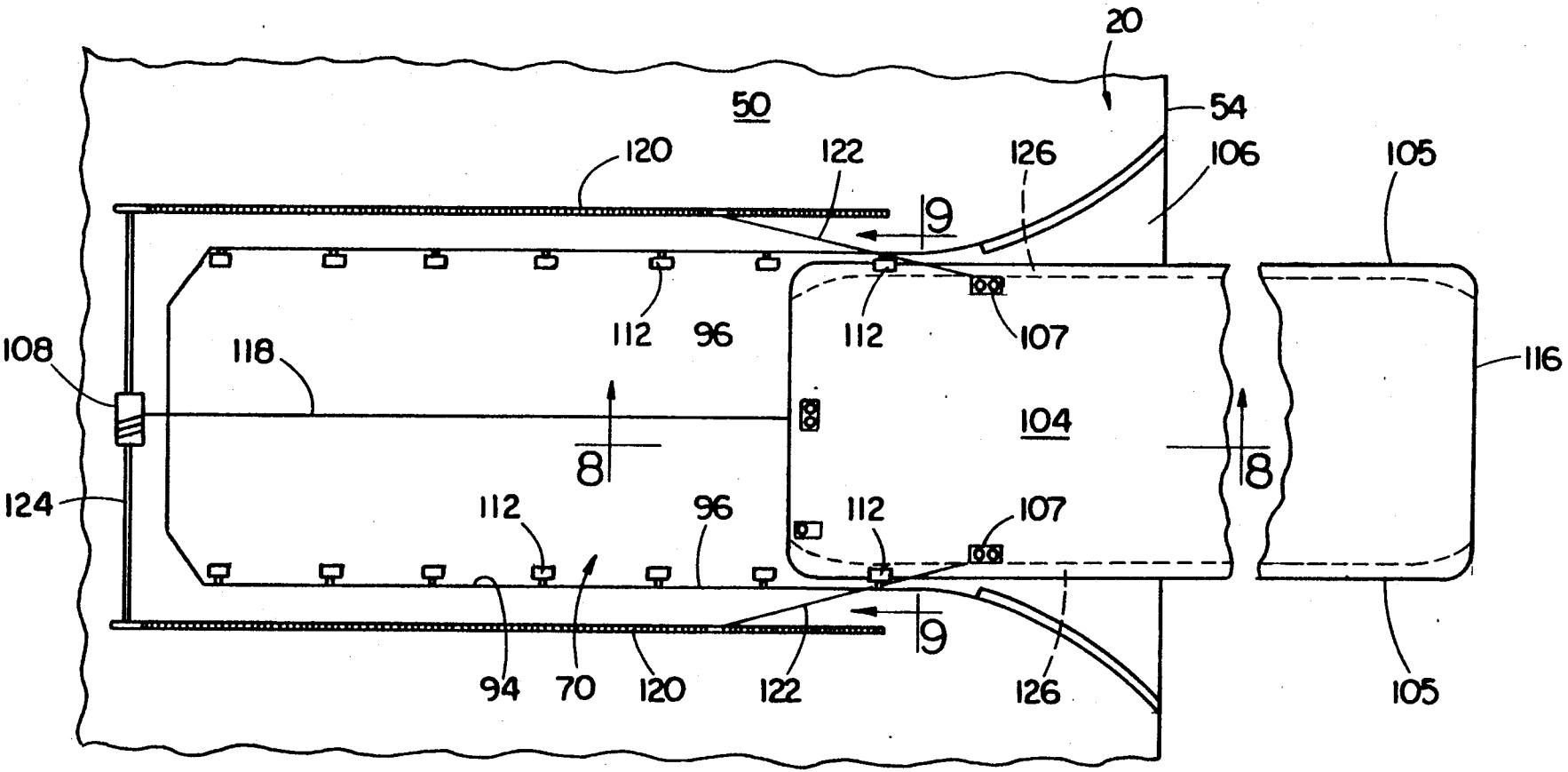
FIG. 7 is a top plan view of a scheme for driving a vessel in the form of a barge into the berthing facility.

Now referring to FIG. 7 there is illustrated a top plan view of a portion of the berthing facility 20, with the enclosure rearward locking gate 100 removed for clarity, and the barge 104, further illustrating the scheme for driving the barge 104 into the enclosure 70. As seen in FIG. 7, the forward end portion 114 of the barge 104 is positioned in the entry 106 of the enclosure 70 and the rearward end portion 116 of the barge 104 is positioned away from the rearward end portion 54 of the platform 50. The barge 104 is aligned with the enclosure 70 so that the sidewalls 105 of the barge 104 are substantially parallel with the sidewalls 76 of the enclosure 70. A line 118 extends from a winch 108 and is connected to the forward end portion 114 of the barge 104. In addition, a pair of endless chain assemblies 120 are connected with mooring points 107 on the surface of the barge 104 via a pair of cables 122. The endless chain assemblies 120 are known in the art and are driven by a shaft 124 that also drives the winch 108. The winch 108 and the pair of endless chain assemblies 120 are driven to pull the barge into the enclosure 70. As the barge 104 is pulled into the enclosure 70, the plurality of resilient transverse members 112, such as spring loaded tires, extending from the sidewalls 76 of the channel 74 pass into a pair of troughs 126, more clearly illustrated in FIG. 9, which are formed in the sidewalls 105 of the barge 104. As previously described, once the resilient transverse members in the form of spring loaded tires 112 are positioned within the troughs 126, running fore and aft of each of the sidewalls 105, the position of the barge 104 within the enclosure 70 is fixed.

Figure 8:
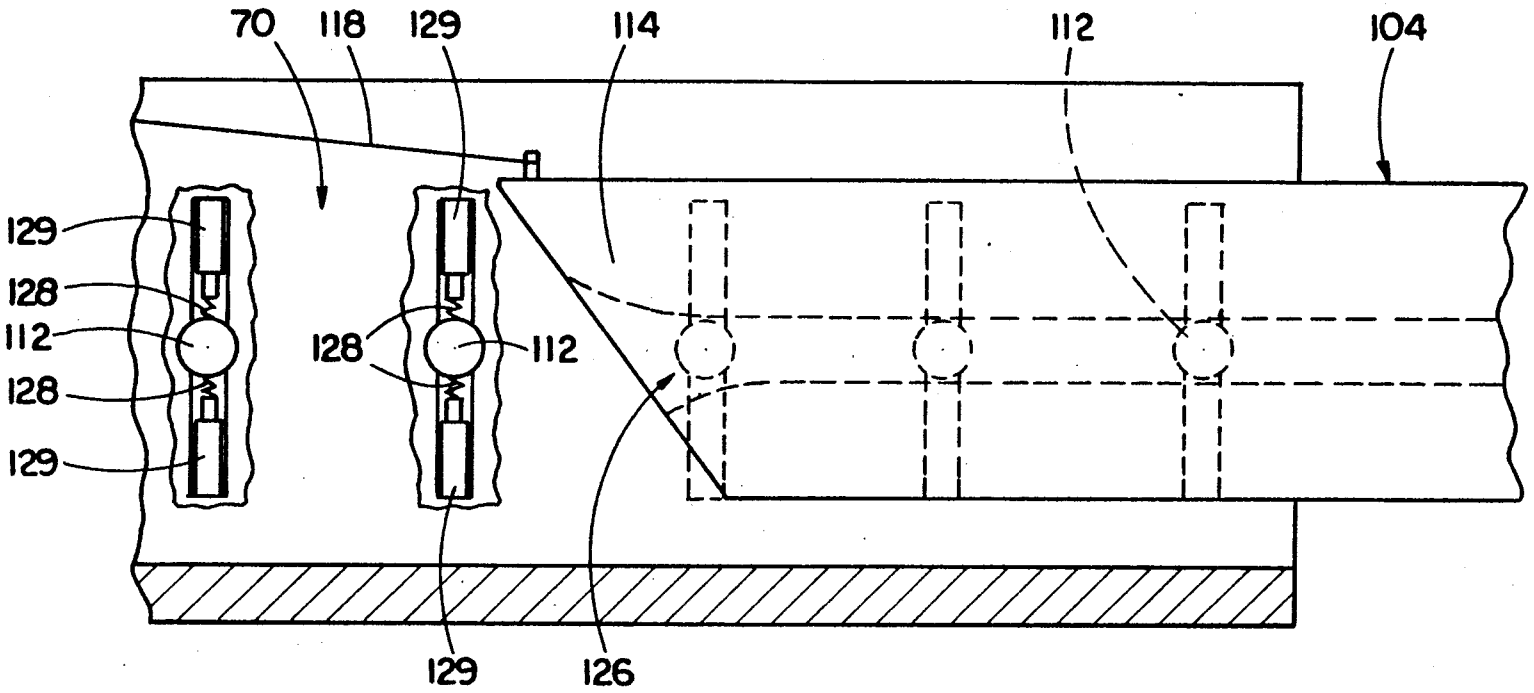
FIG. 8 is a cross-sectional view of the barge and a portion of the berthing facility taken along line 8—8 of FIG. 7.

Now referring to FIG. 8, there is illustrated a side elevational view, partially in section, of one of the troughs 126 of the barge 104 engaging the resilient transverse members, in the form of spring loaded tires 112, positioned on the sidewall 96 of the enclosure 70. As seen in FIG. 8, the trough 126 expands in funnel-like fashion at the forward end portion 114 of the barge 104. The funnel-like end portion of the trough 126 makes up for misalignment between the spring loaded tires 112 and the trough 126 and allows the barge 104 to be easily pulled into the enclosure 70. As the winch line 118 is reeled in and the troughs 126 of barge 104 receive successive spring loaded tires 112, it is apparent that the spring loaded tires themselves must be capable of movement in a vertical plane in order to enter the troughs 126 unless the troughs 126 are perfectly aligned with the spring loaded tires 112. In order to allow the spring loaded tires 112 sufficient movement in the vertical plane, each of the tires 112 is spring loaded as schematically illustrated at 128. The springs 128 allow the tires 112 to move vertically as required to align with the troughs 126. An added benefit to spring loading the tires 112 is that the spring loaded tires not only act as guides but also act as shock absorbers to cushion the impact between the barge 104 and the berthing vessel 20 as the barge 104 is pulled into the enclosure 70. In addition, spring loading the tires 112 permits the barge 104 to move vertically within the enclosure 70 as the draft on the barge 104 changes due to the addition to or removal of barge cargo. Once the barge 104 is positioned within the enclosure 70, the tires are fixed by hydraulically locking the springs 128 via the schematically-illustrated mechanical or hydraulic/pneumatic locking devices 129. The overall draft of the barge is adjusted by raising or lowering all of the spring loaded tires 112 as a unit.

Figure 9:
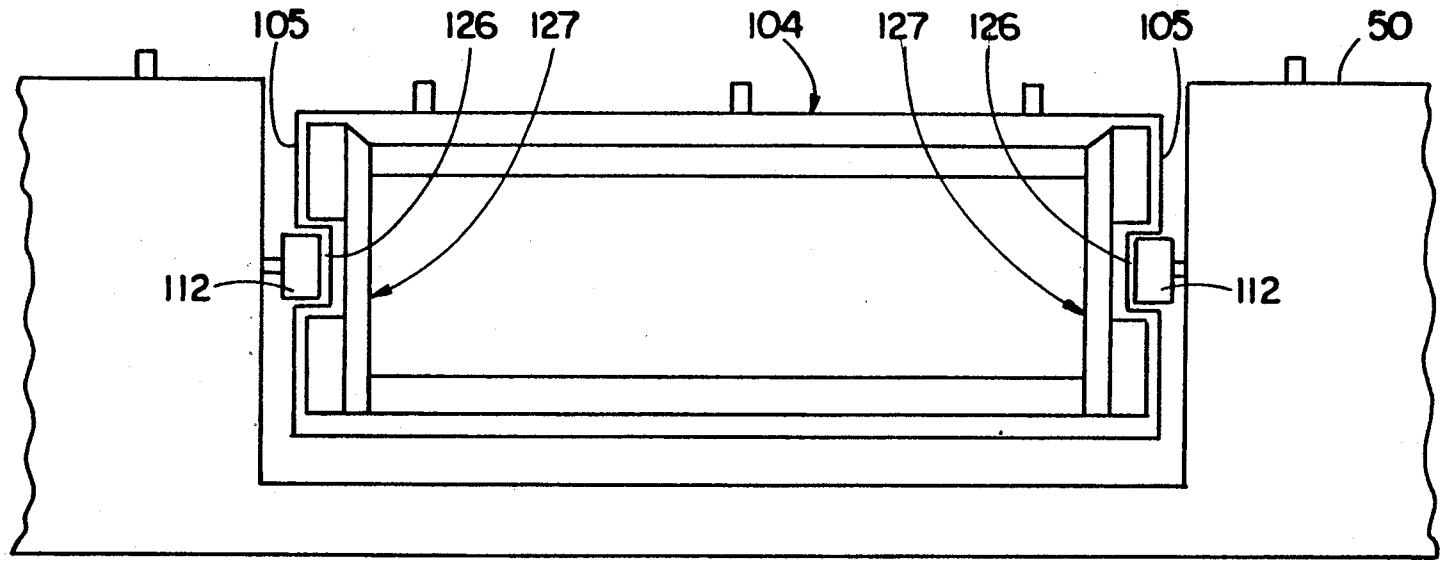
FIG. 9 is a cross-sectional view of the barge and a portion of the berthing facility taken along line 9—9 of FIG. 7, illustrating a scheme for capturing the barge within the berthing facility.

Now referring to FIG. 9, there is illustrated a cross-sectional view of a portion of the buoyant platform 50 and the barge 104 taken along line 9—9 of FIG. 7. As seen in FIG. 9, each of the barge sidewalls 105 has a trough 126 formed integrally therewith for receiving the plurality of spring loaded tires 112. The region around each trough 126 is structurally reinforced by the ironwork, generally designated by the numerals 127, to prevent the barge 104 from being damaged as it enters or exits the berthing facility 20.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof.

I claim:

1. An open ocean-based berthing facility for capturing an ocean-going vessel in order to mitigate wind, wave or current-induced relative motion between said berthing facility and said vessel, comprising:

(a) a buoyant platform having a water filled enclosure formed therein for receiving said vessel and configured to capture said vessel within said platform so that any movement of said vessel is induced by wind, wave or current-induced movement of said platform; and (b) means for fixing the position of said vessel within said enclosure, (c) a water flow apparatus comprised of at least one duct having an inlet below the level of water within said enclosure and extending into the open ocean and a plurality of outlets located within said enclosure and arranged to pass a high volume of water therethrough from said inlet to said plurality of outlets and thereafter towards a vessel entering said enclosure to ease the entry of said vessel into said enclosure.

2. The open ocean-based berthing facility as recited in claim 1, wherein said water filled enclosure is configured so that said vessel is virtually isolated from the open ocean when captured therein.

3. The open ocean-based berthing facility as recited in claim 2, wherein:

said buoyant platform includes a forward end portion, an opposing rearward end portion and a center portion extending therebetween; and said water filled enclosure includes a channel formed in said center section which extends between said forward and rearward end portions and a lock gate positioned at one of said forward and rearward end portions.

4. The open ocean-based berthing facility as recited in claim 2, wherein:

said buoyant platform includes a forward end portion, an opposing rearward end portion and a center portion extending therebetween; and said water filled enclosure includes a channel formed in said center section which extends between said forward and rearward end portions and a pair of opposing forward and rearward lock gates positioned at said forward and rearward end portions, respectively.

5. The open ocean-based berthing facility as recited in claim 4, wherein:

each of said lock gates is movable between an open and a closed position; and one of said lock gates is opened to allow said vessel to be driven into said channel and thereafter said lock gate is closed to capture said vessel within said platform.

6. The open ocean-based berthing facility as recited in claim 5, wherein said channel is formed from a pair of opposing vertical sidewalls extending between said platform forward and rearward end portions, and a horizontally positioned bottom wall extending between said sidewalls so that said channel has a generally "U" shaped appearance when viewed from said platform forward end portion.

7. The open ocean-based berthing facility as recited in claim 6, wherein said channel and said forward and rearward lock gates forming said enclosure isolate said vessel positioned therein from wind, waves or currents when said lock gates are in a closed position to minimize relative motion between said vessel and said berthing platform.

8. The open ocean-based berthing facility as recited in claim 6, wherein said forward and rearward lock gates each have weep holes therethrough to permit water to flow between said enclosure and the open ocean when said forward and rearward lock gates are in a closed position until the water level within said enclosure is equalized with the ocean water level.

9. The open ocean-based berthing facility as recited in claim 6, wherein said vessel is maintained in position within said enclosure by a plurality of resilient members on each of said channel sidewalls which are movable into contact with the hull of said vessel.

10. The open ocean-based berthing facility as recited in claim 2, wherein:

said buoyant platform includes a forward end portion, an opposing rearward end portion and a center portion which extends therebetween; and said water filled enclosure includes a channel extending from said platform rearward end portion a preselected distance into said center portion.

11. The open ocean-based berthing facility as recited in claim 10, wherein said channel is formed from a pair of opposing vertical sidewalls extending from said platform rearward end portion said preselected distance into said center portion and a horizontally positioned bottom wall extending between said side walls so that said channel has a generally "U" shaped appearance when viewed from said platform rearward end portion.

12. An open ocean-based berthing facility for capturing an ocean-going vessel in order to mitigate wind, wave or current-induced relative motion between said berthing facility and said vessel, comprising:

(a) a buoyant platform having a water filled enclosure formed therin for receiving said vessel and configured to capture said vessel within said platform so that any movement of said vessel is induced by wind, wave or current-induced movement of said platform; and (b) means for fixing the positon of said vessel within said enclosure, and wherein said water filled enclosure is configured so that said vessel is virtually isolated from the open ocean when captured therein, said buoyant platform includes a forward end portion, an opposing rearward end portion and a center portion which extends therebetween, said water filled enclosure includes a channel extending from said platform rearward end portion a preselected distance into said center portion, said channel is formed from a pair of opposing vertical sidewalls extending from said platform rearward end portion said preselected distance into said center portion and a horizontally positioned bottom wall extending between said side walls so that said channel has a generally "U" shaped appearance when viewed from said platform rearward end portion, said vessel is a barge having a forward end portion, an opposing rearward end portion and a pair of opposing sidewalls extending between said forward and rearward end portions with each sidewall having a trough formed therein extending between said forward and rearward end portions; and said barge is fixed in position within said enclosure by a plurality of resilient members on each of said channel side walls which are movable into engagement with said troughs formed in said barge sidewalls.

13. The open ocean-based berthing facility as recited in claim 12, wherein said resilient members are spring loaded tires which act as movable guides and shock absorbers for said barge as said barge is received within said enclosure.

14. The open ocean-based berthing facility as recited in claim 13, wherein said resilient members may be raised and lowered vertically relative to the level of water within said enclosure to accommodate draft changes on said barge.

* * * * *